US007210526B2

(12) United States Patent
Knobloch

(10) Patent No.: US 7,210,526 B2
(45) Date of Patent: May 1, 2007

(54) SOLID STATE PUMP

(76) Inventor: Charles Saron Knobloch, 1519 Mission Springs Dr., Katy, TX (US) 77450

( * ) Notice: Subject to any disclaimer, the term of this patent is extended or adjusted under 35 U.S.C. 154(b) by 0 days.

(21) Appl. No.: 11/007,101

(22) Filed: Dec. 7, 2004

(65) Prior Publication Data

US 2006/0037755 A1 Feb. 23, 2006

Related U.S. Application Data

(60) Provisional application No. 60/602,142, filed on Aug. 17, 2004.

(51) Int. Cl.

| | |
|---|---|
| ***E21B 43/00*** | (2006.01) |
| ***E21B 43/267*** | (2006.01) |
| ***B05B 5/12*** | (2006.01) |
| ***H01F 1/00*** | (2006.01) |

(52) U.S. Cl. ..... 166/248; 166/66.5; 166/280.2; 166/369; 166/370; 252/62.51 R; 252/62.53; 252/62.54; 427/127; 427/215; 427/220; 427/221; 428/403; 428/407

(58) Field of Classification Search ..... 166/66.5, 166/248, 280.2

See application file for complete search history.

(56) References Cited

U.S. PATENT DOCUMENTS

| | | | | |
|---|---|---|---|---|
| 4,694,905 | A | 9/1987 | Armbruster | |
| 4,927,334 | A * | 5/1990 | Engdahl et al. | 417/322 |
| 5,792,284 | A * | 8/1998 | Cedell et al. | 148/301 |
| 6,074,179 | A * | 6/2000 | Jokela et al. | 417/322 |
| 6,279,653 | B1 * | 8/2001 | Wegener et al. | 166/249 |
| 6,528,157 | B1 | 3/2003 | Hussain et al. | |
| 6,550,534 | B2 * | 4/2003 | Brett | 166/65.1 |
| 6,607,036 | B2 * | 8/2003 | Ranson et al. | 166/302 |
| 6,725,930 | B2 * | 4/2004 | Boney et al. | 166/280.2 |
| 6,849,195 | B2 * | 2/2005 | Basheer et al. | 252/62.54 |
| 6,904,982 | B2 * | 6/2005 | Judge et al. | 175/213 |
| 2005/0274510 | A1 * | 12/2005 | Nguyen et al. | 166/250.12 |

* cited by examiner

*Primary Examiner*—George Suchfield

(57) ABSTRACT

The present invention is a material and method that enables creation of an in situ pumping action within a matrix or otherwise porous media. This pumping action may be used to move materials, namely fluids, through the matrix or porous media to a gathering point. This pumping action may also be used as a vibrational source, using the movement of the matrix itself as the radiator of vibrational, typically acoustic, energy. This vibrational energy may be used for a variety of purposes.

32 Claims, 1 Drawing Sheet

SOLID STATE PUMP

REFERENCE

Pursuant to 35 U.S.C. 119(e)(1), reference is hereby made to earlier filed provisional Patent Application No. 60/602,142 to Charles Saron Knobloch for Solid State Pump of filing date Aug. 17, 2004.

FIELD OF THE INVENTION

The present invention relates generally to actuating a porous media, which may include moving solids or fluids, liquids or gases, by way of a magneto-restrictive induced pumping action. More specifically, the present invention may be directed to the controlled use of a magneto-restrictive substance, placed within a geologic strata, so as to selectively alter the packing of the strata, effecting fluid movement.

BACKGROUND OF THE INVENTION

Geologic reservoirs generally contain a matrix material, such as sandstone, sand, or limestone. The grains of the matrix material tend to compact against one another. Although the grains of the matrix compact against one another, there still may remain voids, or interstitial volume, in between the grains. Depending on the amount of compaction, these voids make up the porosity and permeability of the reservoir. Other factors affect the ultimate amount of interstitial volume and its corresponding porosity and permeability. Grains of the matrix that are lightly compressed may be in contact with one another at only a small point. This usually results in voids that are greater in volume and having more interconnection with each other. Alternatively, the grains of the matrix may be compressed such that they are slightly crushed one into another, thus greatly reducing the size and interconnection of the voids. Further, solutions may have flowed through the voids, precipitating deposits within the voids. This is typically called cementation. These deposits tend to reduce the interstitial volume and the interconnection of these voids, reducing porosity and permeability.

One way of increasing the permeability, if not also the porosity, of a reservoir is to artificially expand the space between the grains of the matrix. This may be accomplished in many ways. One way is to introduce foreign grains or particles that will open the space between the original grains. These foreign grains are shaped so as to assist in placement. Pressure is applied to the reservoir, forcing an expansion of the matrix. The foreign grains are forced into the existing matrix and the applied pressure is reduced. The matrix relaxes, locking the foreign grains into the matrix. The pressures applied may also be used to force fractures in the matrix itself, where foreign grains may be used to hold open the fractures after the applied pressure is reduced.

These methods of artificially altering the porosity and permeability of the reservoir have been largely successful in the petroleum production industry. However, ultimate petroleum production is still dependent on being able to move the hydrocarbons out of the reservoir and into the well bore.

A number of causes lead to reduced hydrocarbon production long before extraction of all the hydrocarbons in the reservoir. Reservoir pressures may drop or surface pumping means may become inadequate, resulting in decreased production. Excessive draw down may result in water being produced instead of hydrocarbons, possibly creating a water conduit that permanently cuts hydrocarbon production from recovery by the well. Excessive draw down may also result in collapse of the matrix, where the matrix itself is extracted, such as sand production, causing loss of hydrocarbon production and damage to the well.

BRIEF SUMMARY OF THE INVENTION

What I am about to describe here is a new way to move solids or fluids through a porous media. For purposes of illustration, I am using geologic strata containing hydrocarbon fluids, namely a petroleum reservoir. However, it can be easily seen that other solids or fluids, such as water or gases, can be moved using this technique. Also, the porous media need not be a geologic formation or strata. A manufactured or naturally occurring porous media may be embedded with a magneto-propant to create the solid state pump of the present invention.

The term "solid state" is used here for convenience as an allusion to its use in electronics to differentiate transistors from vacuum tubes, which historically were called valves. In solid state applications, the routes of electrons are controlled within semi-conductor substances rather than physically manipulated in a vacuum tube. This analogy leads to a simple, easy to remember naming for the magneto-restrictive pump of the present invention.

In the present invention, the magneto-propant need not be a solid material. Magneto-restrictive fluids or gels may be used.

The present invention is a material and method that enables creation of an in situ pumping action within the matrix itself. This pumping action may be used to move materials, namely fluids, through the matrix to a gathering point, typically a well bore. This pumping action may also be used as a vibrational source, using the movement of the matrix itself as the radiator of vibrational, typically acoustic, energy. This vibrational energy may be used for a variety of purposes.

The present invention may use any magneto-restrictive material, although specifically the material known as Terfenol-D®, an alloy containing iron, terbium, and dysprosium, in its various formulations, is used for purposes of illustrating the present invention. Magneto-restrictive materials change at least one of their dimensional characteristics in the presence or absence of a magnetic field. Terfenol-D ® exhibits a large mechanical force per unit area in a particular axial direction in the presence of a magnetic field. Its large force per unit area makes Terfenol-D ® particularly attractive for the desired pumping action of the present invention.

Current industry practice appears to use both the term "magneto-restrictive" and the term "magnetostrictive" for essentially the same meaning. The term "magneto-restrictive" is used here for convenience to mean either "magneto-restrictive" or "magnetostrictive" and as herein defined.

A coating or encapsulation substance is desired to protect the magneto-restrictive material from damage. Additionally, the coating may be used to provide the desired type of surface tension and shape for the individual grains. The coating may be cured such that a particular orientation of the magneto-restrictive material, relative to the shape of the coating, is achieved.

The resulting material, with or without coating, may be called a called a magneto-propant.

BRIEF SUMMARY OF THE INVENTION—OBJECTS AND ADVANTAGES

It is an object of the present invention to enable in-situ actuation of a porous media, specifically a geologic strata representing a geologic hydrocarbon reservoir.

It is a further object of the present invention to use the actuation of a porous media to move fluids, such as hydrocarbons, from the porous media to a collection receptacle, such as a well bore.

It is an advantage of the present invention to directly actuate the porous media itself, rather than by indirect means, such as by acoustic stimulation.

It is an advantage of the present invention to be able to actuate a porous media at very low, sub-sonic frequencies.

BRIEF DESCRIPTION OF THE SEVERAL VIEWS OF THE DRAWING

The present invention and its advantages will be better understood by referring to the following detailed description and the attached drawings in which.

REFERENCE NUMERALS IN DRAWINGS

Figure 1:
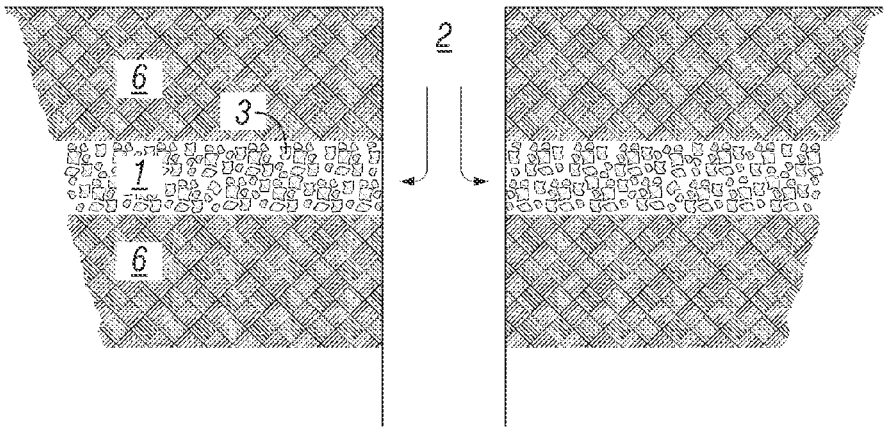
FIG. 1 shows a cross-sectional diagrammatic view illustrating strata containing a reservoir, pierced by a well bore.

The following elements are numbered as described in the drawings and detailed description of the invention:

| | |
|---|---|
| 1 geologic reservoir | 2 well bore |
| 3 matrix material | 4 magneto-propant |
| 5 magnetic source | 6 strata |

DETAILED DESCRIPTION OF THE INVENTION

Magneto-Proppant

A magneto-propant is made by selecting a magneto-restrictive substance of desired size and, optionally, applying a coating. The coating, an encapsulation substance, may serve to protect the magneto-propant or provide enhanced propant characteristics. Various coatings are currently used in the industry. Examples include: a polytetrafluoroethylene such as Teflon®, silicone, gel, resin, phenolic resin, pre-cured phenolic resin, curable phenolic resin, liquid thermoset resin, epoxy resin, furan resin, and furan-phenolic resin. Further examples include: a high ortho resin, hexamethylenetetramine, a silane adhesion promoter, a silicone lubricant, a wetting agent and a surfactant.

One process for producing such coated magneto-restrictive particles consists essentially of mixing an uncured thermosetting resin with magneto-restrictive particulate matter preheated to temperatures of about 225° F. to 450° F. Examples of the resin include: furan, the combination of a phenolic resin and a furan resin, or a terpolymer of phenol, furfuryl alcohol and formaldehyde. Further examples include: bisphenolic-aldehyde novolac polymer, novolac polymer, a resole polymer and mixtures thereof. The resin may also be time-cured by maintaining an elevated temperature, for example, above about 200° F.

The magneto-restrictive substance may also be mixed with other particulate matter, such as: sand, bauxite, zircon, ceramic particles, glass beads and mixtures thereof. The other particulate matter assists in emplacement and propant function.

The encapsulation substance may also be used to guide the shape of the magneto-propant. In one example, the encapsulation substance may be shaped so as to generally align the magneto-restrictive substance in a vertical orientation when immersed in a fluid.

Some coatings may affect the ability of the magneto-restrictive substance to change dimensional shape. In that regard, coatings which retain a somewhat flexible characteristic may be preferred over coatings which are brittle under the stress caused by shape change of the magneto-restrictive material.

The coating may also include various additional substances, such as fibers, to enhance the external characteristics of the magneto-propant. These fibers may also extend outward from the coating. Examples of such fibers include: milled glass fibers, milled ceramic fibers, milled carbon fibers, natural fibers and synthetic fibers having a softening point of at least about 200° F.

In at least one embodiment, the coating may comprise about 0.1 to about 15% fibrous material based on particulate substrate weight. In another embodiment, the coating may comprise about 0.1 to about 3% fibrous material based on particulate substrate weight. In at least one embodiment, the resin may be present in an amount of about 0.1 to about 10 weight percent based on substrate weight. In another embodiment, the resin may be present in an amount of about 0.4 to about 6 weight percent based on substrate weight. In at least one embodiment, the fibrous material may have a length from about 6 microns to about 3200 microns and a length to aspect ratio from about 5 to about 175. The fibrous material may have a round, oval, or rectangular cross-section transverse to the longitudinal axis of the fibrous material The size of the magneto-propant may be varied to suit the porous media and specific application. For example, for hydrocarbon reservoir applications, the mesh size of the magneto-restrictive substance may be between 10 mesh and 100 mesh. Another example, using USA Standard Testing Screen numbers, the magneto-restrictive substance may be between 8 and 100.

Method of Application

As illustrated in FIG. 1, typically, pressure is introduced into a geologic reservoir 1 through a well bore 2. Geologic reservoir 1 comprises a matrix material 3. Strata 6 may surround geologic reservoir 1. Enough pressure is introduced to allow flow of fluids into reservoir 1, perhaps expanding or even fracturing matrix 3.

Figure 2:
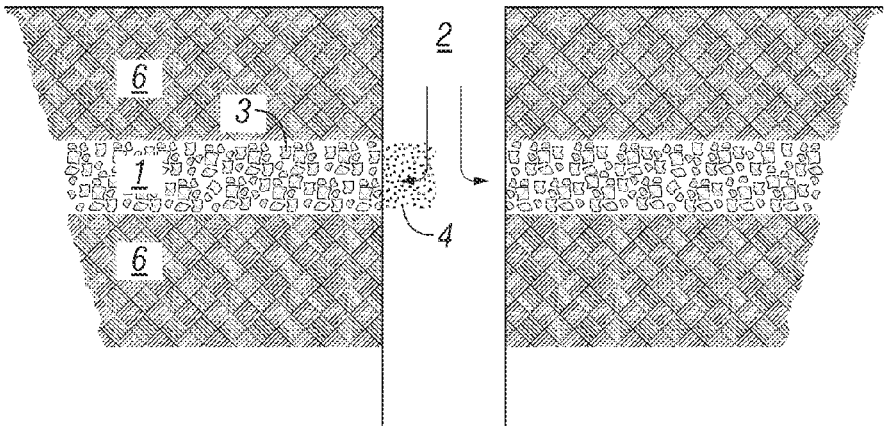
FIG. 2 shows a cross-sectional diagrammatic view illustrating emplacement of a magneto-propant in the context of a typical application.

As illustrated in FIG. 2, a magneto-propant 4 is injected into reservoir 1. Magneto-propant 4 may be added along with other materials, such as guar gel. Once magneto-propant 4 is injected into reservoir 1, the pressure introduced into reservoir 1 is relaxed. Magneto-propant 4 now becomes emplaced within matrix 3.

Figure 3:
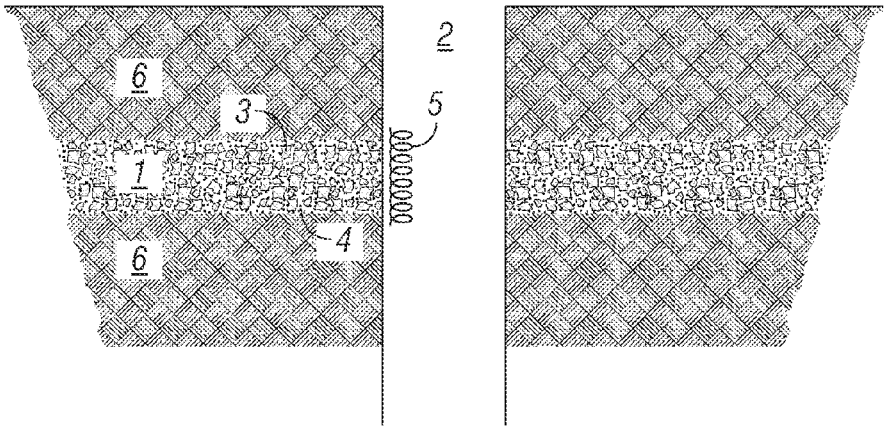
FIG. 3 shows a cross-sectional diagrammatic view illustrating illustrating the magneto-propant as emplaced, actuated by a magnetic source.

As illustrated in FIG. 3, a magnetic source 5 is introduced into well bore 2, or otherwise placed in proximity to the injected magneto-propant 4. Magneto-propant 4, as emplaced within matrix 3, may now be used to act as a solid state pump, or otherwise actuate geologic reservoir 1 or surrounding strata 6.

An alternate method of emplacement of the magneto-propant into the matrix is to apply a magnetic field to orient the magneto-propant prior to relaxing the introduced pressure. The magnetic field assists in orienting the magneto-propant into a desired orientation.

A further alternate method is to apply a magnetic field of such intensity that the magneto-propant changes its dimensional shape. The shape-changing effect will occur up to a certain distance away from the source of the magnetic field. The greater the intensity of the magnetic field, the greater the distance that the shape-changing effect is achieved. The pressure introduced into the reservoir is then relaxed while the magneto-propant remains in its changed shape. The magneto-propant becomes emplaced into the matrix. The magnetic field is then removed, further securing the magneto-propant into the matrix. Pressures may be measured before, during, and after the magnetic field is removed, giving an indication of the effectiveness of the injection of the magneto-propant into the reservoir.

Operation

The solid state pump is actuated by applying a magnetic field of sufficient intensity to change the shape or orientation of the magneto-propant or its underlying magneto-restrictive substance. Beyond a certain distance away from the magnetic source, the intensity of the magnetic field will be too low to activate the shape changing properties of the magneto-propant. This distance may be reduced by reducing the intensity of the magnetic field. Typically, the magnetic field intensity is initially introduced at some maximum intensity, then reduced in intensity over time. The effect is that distant from the magnetic source, the matrix is pushed open by the activation of the shape-changing magneto-propant. As the magnetic field intensity decreases, the distant magneto-propant will no longer be activated. Their shape-changing properties will cease, relaxing the matrix. Fluids will be under pressure to move towards the portions of the matrix which are still held open by the magneto-propant. As the magnetic field intensity continues to decrease, the matrix will continue to relax in the direction of the source of the magnetic field. Typically, the magnetic field source resides in a well bore. Any well bore in the path of this advancing field, or situated at or near the source of the magnetic field, will more readily receive the advancing fluids, the well bore typically having great porosity, permeability, and significant pressure drop.

Each rise and fall of the intensity of the magnetic field may be called a pump cycle. The rise and fall of the intensity of the magnetic field, the pump cycle, may be repeated to create a pumping action.

This pumping action may be used as a vibration source, using the movement of the matix itself as the radiator of vibrational energy.

The shape of the pump cycle, as well as the length of time to complete a pump cycle and the repeat rate of the pump cycles, may be adjusted to optimize the desired pumping action. Generally, a preferred shape for the pump cycle is one where the magnetic field intensity rises quickly to maximum, allowing the expanded space, or area of reduced relative pressure, in the matrix to fill with fluids. The magnetic field intensity then gradually drops, allowing the matrix to relax first in the outermost regions, then towards the innermost region, pushing fluids towards the innermost regions. Well bores situated in the innermost regions collect the pushed fluids.

Certain magneto-restrictive materials, such as Terfenol-D ®, may change shape at either low or relatively high frequencies, up to 40,000 times per second or more. This either allows the pump cycle to operate at relatively high frequencies, or allows the superimposition of relatively high frequencies on an otherwise relatively low frequency pump cycle. For example, a pump cycle may take place over a five second to several minute period. The penetration of the magnetic field may be quite far, owing to the relatively low frequency required of the source of the magnetic field. Superimposed on that pump cycle may be a fluctuating magnetic field of, say 8,000 cycles per second. This fluctuating magnetic field may induce a vibration in the magneto-propant. One use for this vibration is to reduce surface tension inside the matrix, enabling greater fluid flow. The superimposed fluctuating magnetic field may also have a shaped waveform, thereby imparting additional directional preference to the movement of fluids.

Many magneto-restrictive materials, including Terfenol-D®, may be manufactured with slight adjustments to formulation or manufacturing process so as to have varying magneto-restrictive characteristics. One such characteristic is the natural resonant frequency, the frequency of change of the applied magnetic that produces the greatest magneto-restrictive effect. For example, the natural resonant frequency of Terfenol-D ® may be varied slightly depending on its physical dimensions and its formulation. These varying magneto-restrictive properties can be used to create a plurality of magneto-propants having slightly varying magneto-restrictive response. By controlling the location that each of the plurality of varying magneto-propants take in the porous media, additional control of the pumping action may be gained. In this regard, varying the frequency of fluctuation of the applied magnetic field will produce varying degrees of responsiveness from the various magneto-propants.

Although the description above contains many specifications, these should not be construed as limiting the scope of the invention but as merely providing illustrations of some of the presently preferred embodiments of this present invention. Persons skilled in the art will understand that the method and apparatus described herein may be practiced, including but not limited to, the embodiments described. Further, it should be understood that the invention is not to be unduly limited to the foregoing which has been set forth for illustrative purposes. Various modifications and alternatives will be apparent to those skilled in the art without departing from the true scope of the invention, as defined in the following claims. While there has been illustrated and described particular embodiments of the present invention, it will be appreciated that numerous changes and modifications will occur to those skilled in the art, and it is intended in the appended claims to cover those changes and modifications which fall within the true spirit and scope of the present invention.

What is claimed is:

1. A method of pumping using a magneto-restrictive pump comprising the steps of:

a) applying a magnetic field to a porous media containing a magneto-propant; and b) relaxing said magnetic field.

2. The method of claim 1 wherein said magnetic field application step further comprises the steps of:

fluctuating said magnetic field; and sweeping the frequency of said fluctuating magnetic field, thereby determining the optimum rate of fluctuation for production.

3. The method of claim 1 wherein said magneto-propant comprises:

a magneto-restrictive substance; and an encapsulation substance at least partially coating said magneto-restrictive substance.

4. The method of claim 3 wherein said magneto-restrictive substance is comprised of an alloy further comprising iron, terbium, and dysprosium.

5. The method of claim 3 wherein said encapsulation substance is comprised of a substance selected from the group consisting of polytetrafluoroethylene, silicone, gel, resin, phenolic resin, pre-cured phenolic resin, curable phenolic resin, liquid thermoset resin, epoxy resin, furan resin, furan-phenolic resin.

6. The method of claim 3 wherein said encapsulation substance is shaped so that the axial orientation of said magneto-restrictive substance floats in an approximately vertical orientation.

7. The method of claim 3 wherein said magneto-propant further comprises particulate matter selected from the group consisting of sand, bauxite, zircon, ceramic particles, glass beads and mixtures thereof.

8. The method of claim 3 wherein said magneto-restrictive substance is between 10 mesh to 100 mesh in size.

9. The method of claim 1 wherein said magneto-propant is made in accordance with a process for producing coated particulate material consisting essentially of magneto-restrictive particles resistant to melting at temperatures below about 450° F., comprising: mixing an uncured thermosetting resin with said magneto-restrictive particulate matter preheated to temperatures of about 225° F. to 450° F., wherein the resin is selected from the group consisting of furan, the combination of a phenolic resin and a furan resin, or a terpolymer of phenol, furfuryl alcohol and formaldehyde.

10. The method of claim 9 wherein said process of making said magneto-propant further comprises the step of maintaining the magneto-restrictive particulate matter-resin mixture at a temperature of above about 200° F. for a time sufficient to cure the resin.

11. The method of claim 1 wherein said magneto-propant comprises:

a magneto-restrictive particulate substrate; and a coating comprising resin and fibrous material, wherein the fibrous material is embedded in the coating to be dispersed throughout the coating.

12. The method of claim 11 wherein said magneto-restrictive particulate substrate comprises an alloy further comprising iron, terbium, and dysprosium.

13. The method of claim 11 wherein said magneto-restrictive particulate substrate has a particle size in the range of USA Standard Testing screen numbers from about 8 to about 100.

14. The method of claim 11 wherein the fibrous material is selected from the group consisting of milled glass fibers, milled ceramic fibers, milled carbon fibers, natural fibers and synthetic fibers having a softening point of at least about 200° F.

15. The method of claim 11 wherein the coating comprises about 0.1 to about 15% fibrous material based on particulate substrate weight.

16. The method of claim 11 wherein the coating comprises about 0.1 to about 3% fibrous material based on particulate substrate weight.

17. The method of claim 11 wherein the fibrous material has length from about 6 microns to about 3200 microns and a length to aspect ratio from about 5 to about 175.

18. The method of claim 17 wherein the fibrous material has a round, oval, or rectangular cross-section transverse to the longitudinal axis of the fibrous material.

19. The method of claim 11 wherein the resin is present in an amount of about 0.1 to about 10 weight percent based on substrate weight.

20. The method of claim 11 wherein the resin is present in an amount of about 0.4 to about 6 weight percent based on substrate weight.

21. The method of claim 11 wherein the resin comprises a member selected from the group consisting of a novolac polymer, a resole polymer and mixtures thereof.

22. The method of claim 11 wherein the coating comprises a high ortho resin. hexamethylenetetramine, a silane adhesion promoter, a silicone lubricant, a wetting agent and a surfactant.

23. The method of claim 11 wherein the resin comprises a member of the group consisting of a phenolic/furan resin, a furan resin, and mixtures thereof.

24. The method of claim 11 wherein the resin comprises a bisphenolic-aldehyde novolac polymer.

25. The method of claim 11 wherein the resin comprises a cured resin.

26. The method of claim 11 wherein the resin comprises a curable resin.

27. The method of claim 11 wherein the fibrous material is dispersed within the resin.

28. The method of claim 11 wherein the fibrous material is completely within the resin.

29. The method of claim 11 wherein the fibrous material is partially embedded in the resin so as to extend from the resin.

30. A method of adapting magneto-restrictive pump efficiency comprising the steps of:

applying a plurality of magnetic pulses wherein each said magnetic pulse comprises applying a magnetic field to a porous media containing a magneto-propant and relaxing said magnetic field over a first period of time; and varying said plurality of magnetic pulses over a second period of time wherein said varying step comprises changing said first period of time for relaxation of said magnetic field for at least one of said plurality of magnetic pulses.

31. The method of claim 1 or claim 30 or claim 2 wherein said porous media is a strata of material.

32. The method of claim 1 or claim 30 or claim 2 wherein said porous media is a geologic reservoir.

* * * * *